US007868836B2

(12) United States Patent
Vendik et al.

(10) Patent No.: US 7,868,836 B2
(45) Date of Patent: Jan. 11, 2011

(54) ANTENNA AND MOBILE TERMINAL

(75) Inventors: Orest Genrihovich Vendik, St. Petersburg (RU); Ivan Andreevich Pakhomov, St. Petersburg (RU); An Sun Hyun, Seoul (KR); Kang Jae Jung, Seoul (KR); Dong Ho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 393 days.

(21) Appl. No.: 11/747,100

(22) Filed: May 10, 2007

(65) Prior Publication Data

US 2008/0024381 A1 Jan. 31, 2008

Related U.S. Application Data

(60) Provisional application No. 60/820,476, filed on Jul. 26, 2006.

(30) Foreign Application Priority Data

Dec. 28, 2006 (KR) ..... 10-2006-0135938

(51) Int. Cl.
*H01Q 21/00* (2006.01)

(52) U.S. Cl. ..... 343/726; 343/853; 343/816; 343/866

(58) Field of Classification Search ..... 343/725, 343/726, 853, 866, 816
See application file for complete search history.

(56) References Cited

U.S. PATENT DOCUMENTS 5,198,826 A * 3/1993 Ito ..... 343/726
5,465,099 A * 11/1995 Mitsui et al. ..... 343/730
7,408,517 B1 * 8/2008 Poilasne et al. ..... 343/742
7,456,798 B2 * 11/2008 Wong et al. ..... 343/742

FOREIGN PATENT DOCUMENTS

JP 2002151948 A * 5/2002

* cited by examiner

*Primary Examiner*—Douglas W Owens
*Assistant Examiner*—Dieu Hien T Duong
(74) *Attorney, Agent, or Firm*—Lee, Hong, Degerman, Kang & Waimey

(57) ABSTRACT

An antenna for a mobile terminal includes a substrate, a dipole placed on the substrate, a loop placed on the substrate, and a matching circuit on the substrate. The matching circuit comprises at least one of a variable capacitor or a variable inductor. The radiation center of the loop substantially coincides with the radiation center of the dipole.

16 Claims, 19 Drawing Sheets

ANTENNA AND MOBILE TERMINAL

This nonprovisional application claims priority under 35 U.S.C. §119(e) on U.S. Provisional Application No. 60/820,476 filed Jul. 26, 2006 and under 35 U.S.C. §119(a) on Korean Patent Application No. 10-2006-0135938 filed Dec. 28, 2006, the entire contents of which are hereby incorporated by reference.

BACKGROUND

1. Field of the Invention

The present invention relates to an antenna and a mobile terminal comprising the antenna.

2. Description of the Related Art

In recent years, considerable attention has been given to studying fields in the near zone (Fresnel zone) of a radiating dipole. This is due, in particular, to the development of antennas for mobile telephones, since the user of a mobile telephone is in the near zone of the ultrahighfrequency radiator entering into the composition of the telephone apparatus.

SUMMARY

Accordingly, the present invention has been made to solve the above-mentioned problems occurring in the related art.

Additional advantages, objects and features of the invention will be set forth in part in the description which follows and in part will become apparent to those having ordinary skill in the art upon examination of the following or may be learned from practice of the invention.

In one aspect of the present invention, there is provided an antenna comprising a radiator combining a small dipole and a small loop.

In another aspect of the present invention, there is provided a mobile terminal comprising the antenna described above.

BRIEF DESCRIPTION OF THE DRAWINGS

The above and other objects, features and advantages of the present invention will be more apparent from the following detailed description taken in conjunction with the accompanying drawings, in which.

For the dipole-loop pair, the imaginary part of the Poynting vector flux does not exceed 0.01 W in magnitude.

Figure 4:
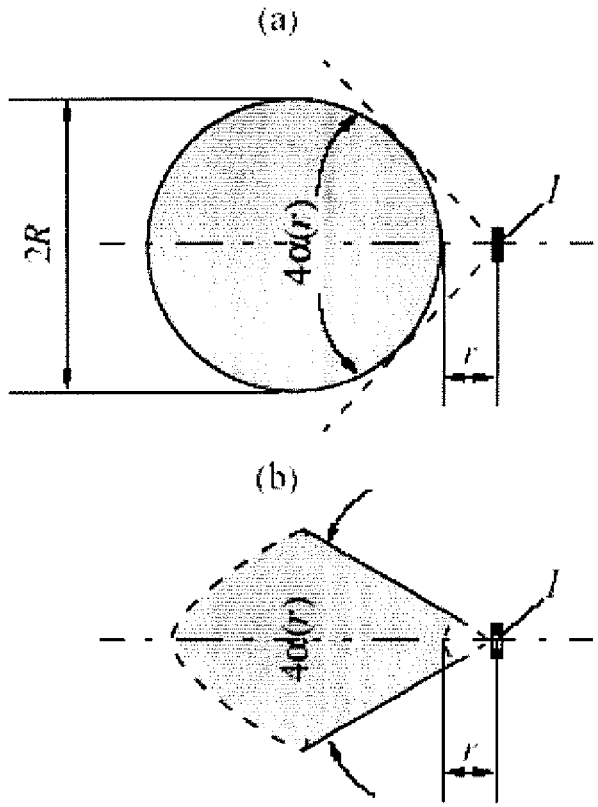

FIG. 4 shows (a) an arrangement of the (1) microradiator and an absorbing element near it and (b) simplified scheme of this arrangement for calculating the absorbed power.

Figure 5:
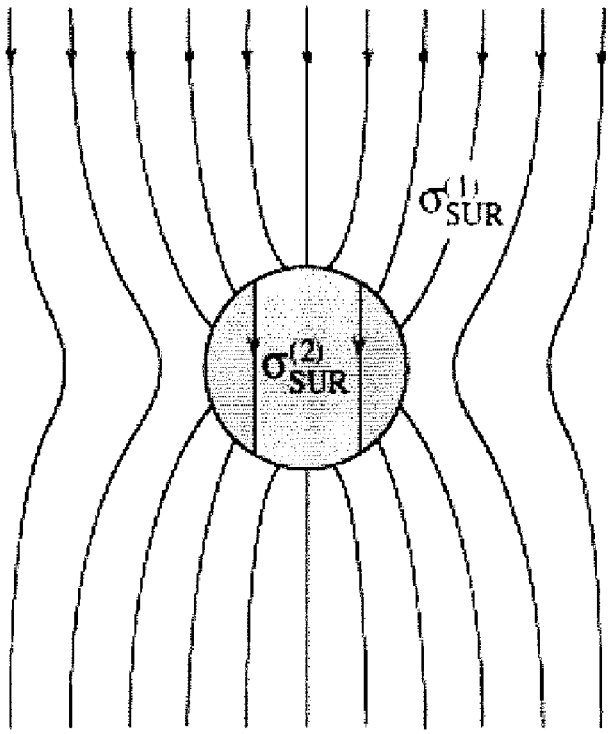

FIG. 5 displays the distribution of the lines of force of the electric field on a planar conducting surface having conductivity $\sigma^{(1)}_{SUR}$ and containing an inserted disk of conductivity $\sigma^{(2)}_{SUR}$.

Figure 6:
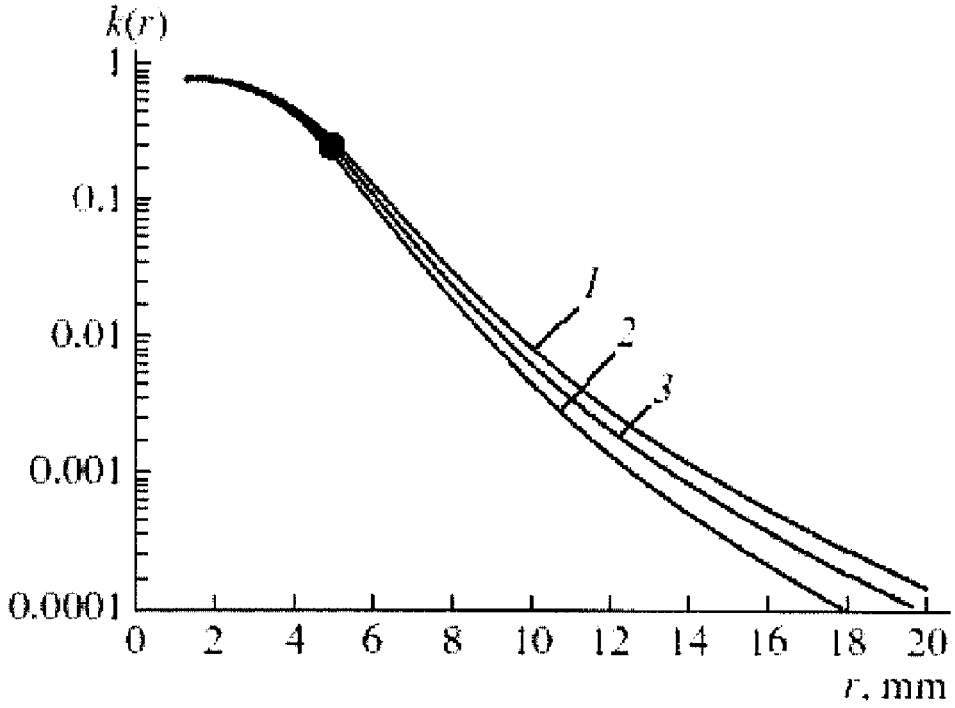

FIG. 6 shows the specific absorption coefficient as a function of the distance between the microradiator and the absorbing object surface at $\theta_0=\pi/2$ for three microradiator types considered in the present study: a dipole-loop pair at $\phi_0$=(1)0 and (2)$\pi$ and (3) a dipole or a loop. The point represents an experimental result.

Figure 7:
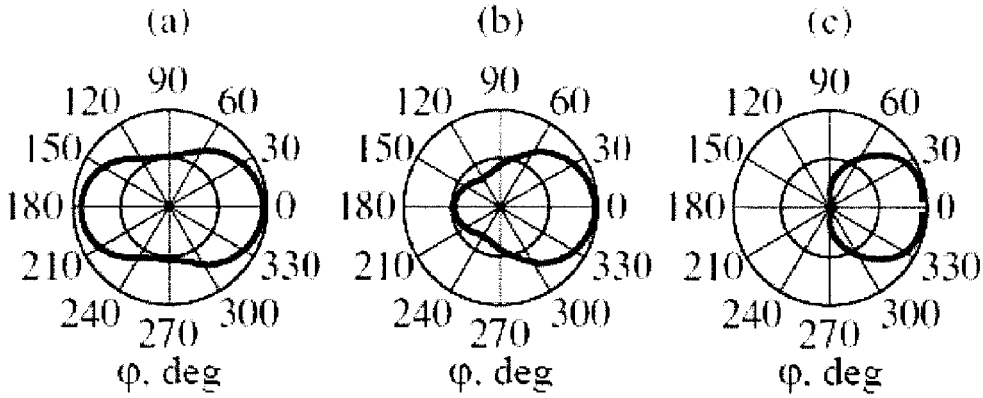

FIG. 7 shows dependence of $\kappa(\phi_0, \theta_0, r)$ on $\phi_0$ at $\theta_0=\pi/2$ for r=(a) $\lambda/15$, (b) $\lambda/8$, and (c) $\lambda/2$.

Figure 8:
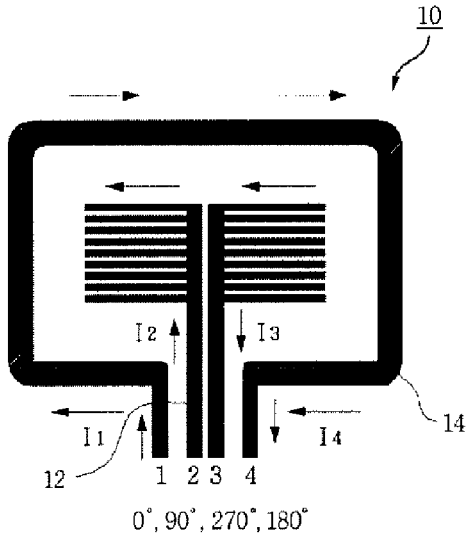

FIG. 8 schematically shows a radiator combining a dipole and a loop according to the second embodiment of the invention.

Figure 9A:
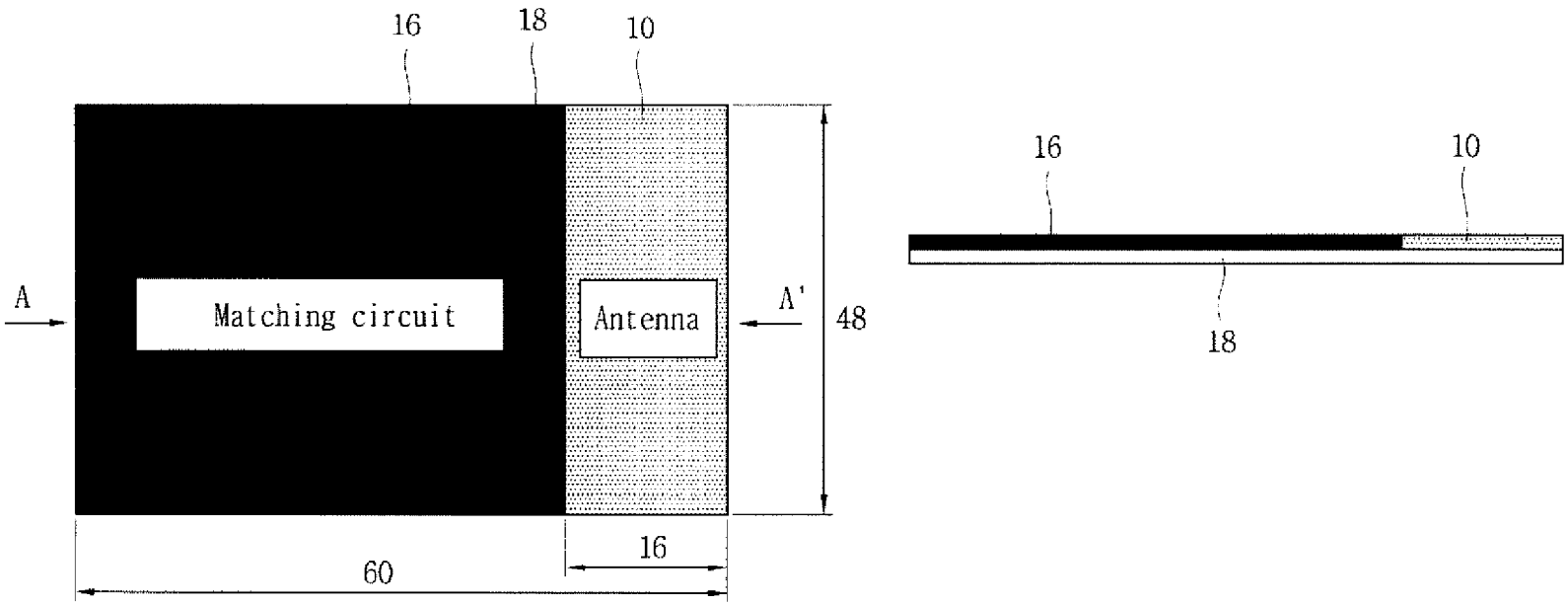
Figure 9B:
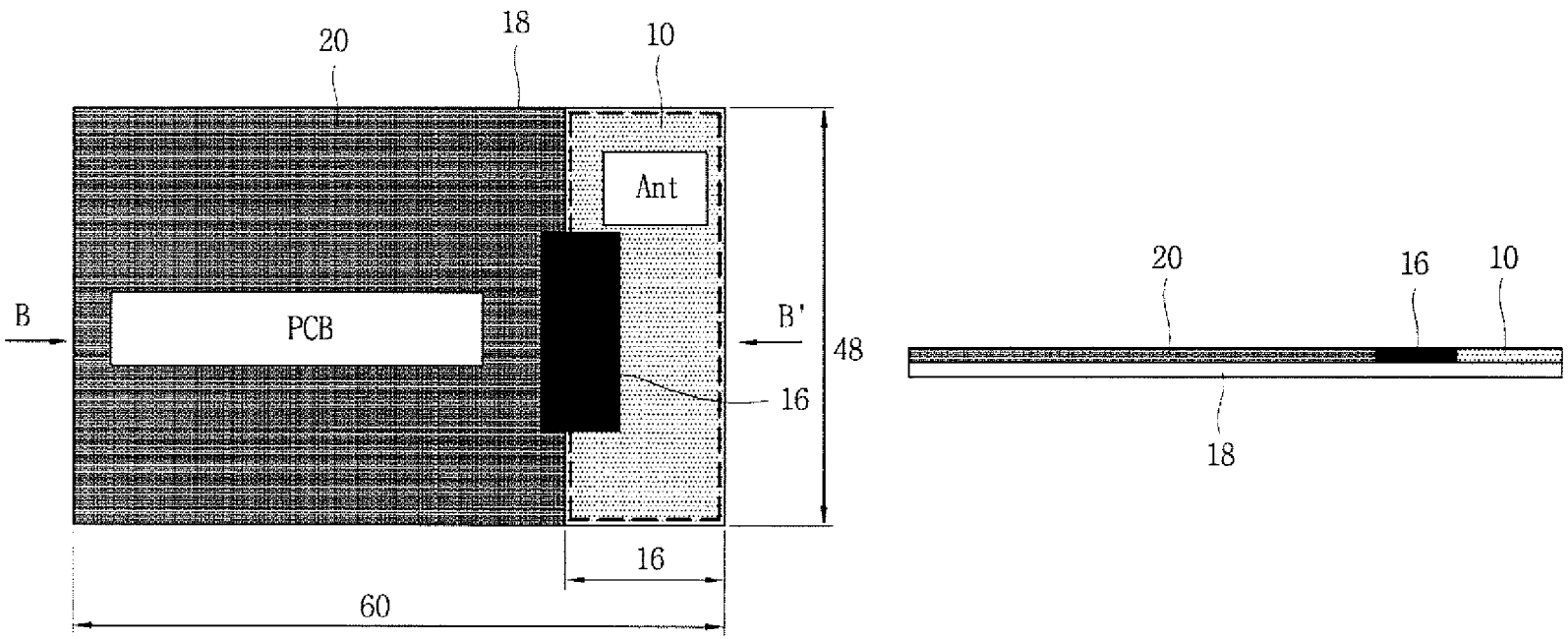

FIGS. 9*a* and 9*b* schematically shows layout of the antenna and matching circuit according to the second embodiment of the invention.

Figure 10A:
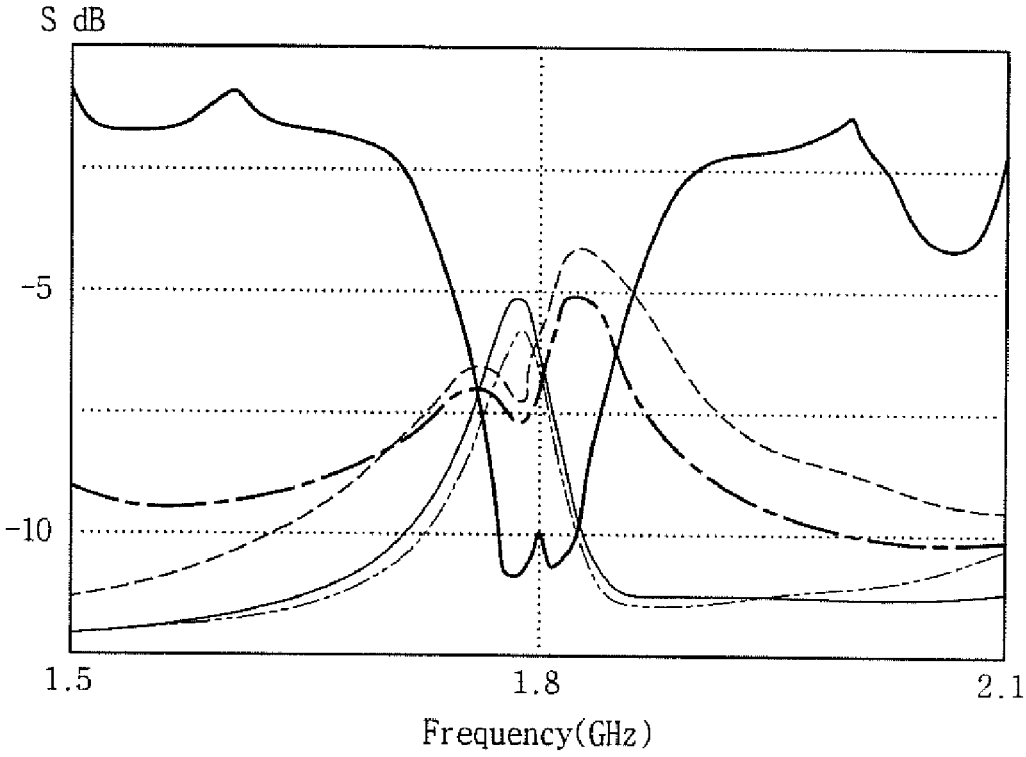
Figure 10B:
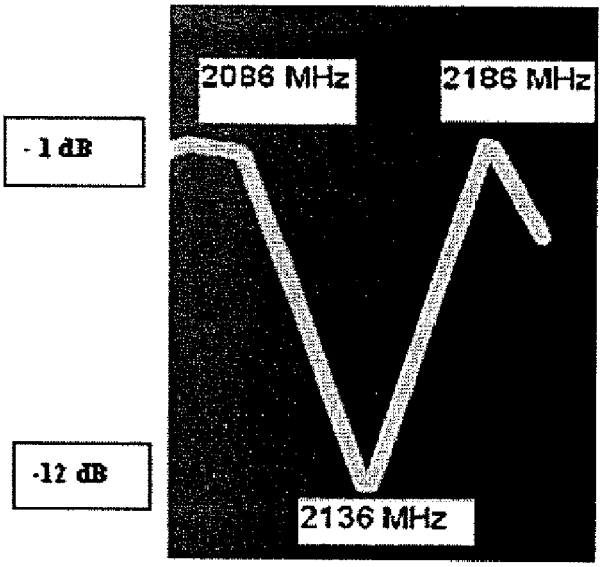

FIGS. 10*a* and 10*b* shows the performance of antenna matching of FIG. 8.

Figure 11A:
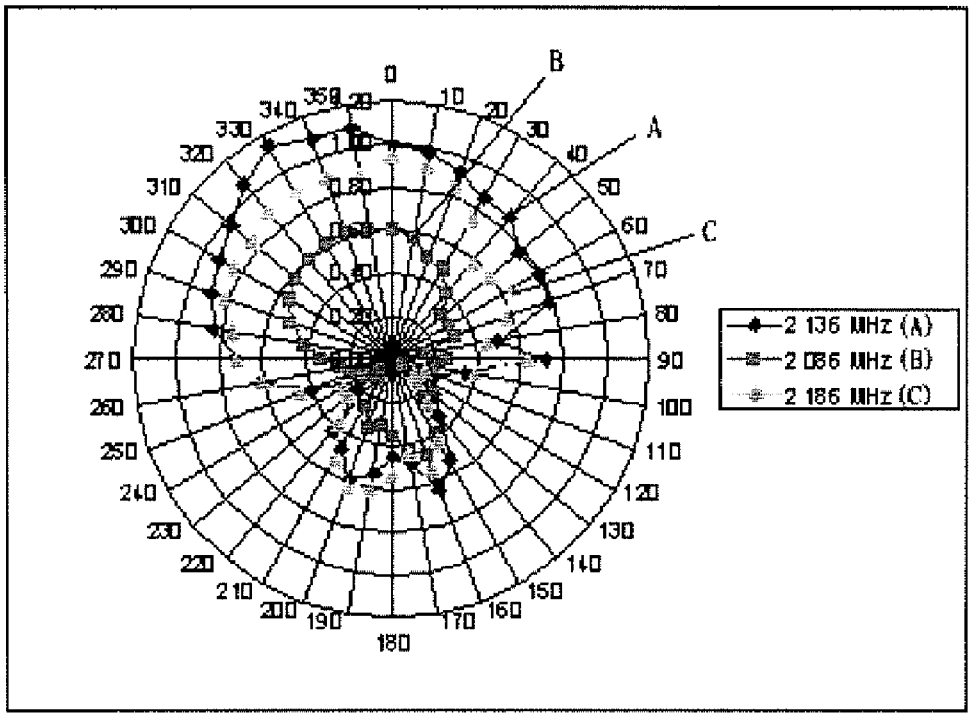
Figure 11B:
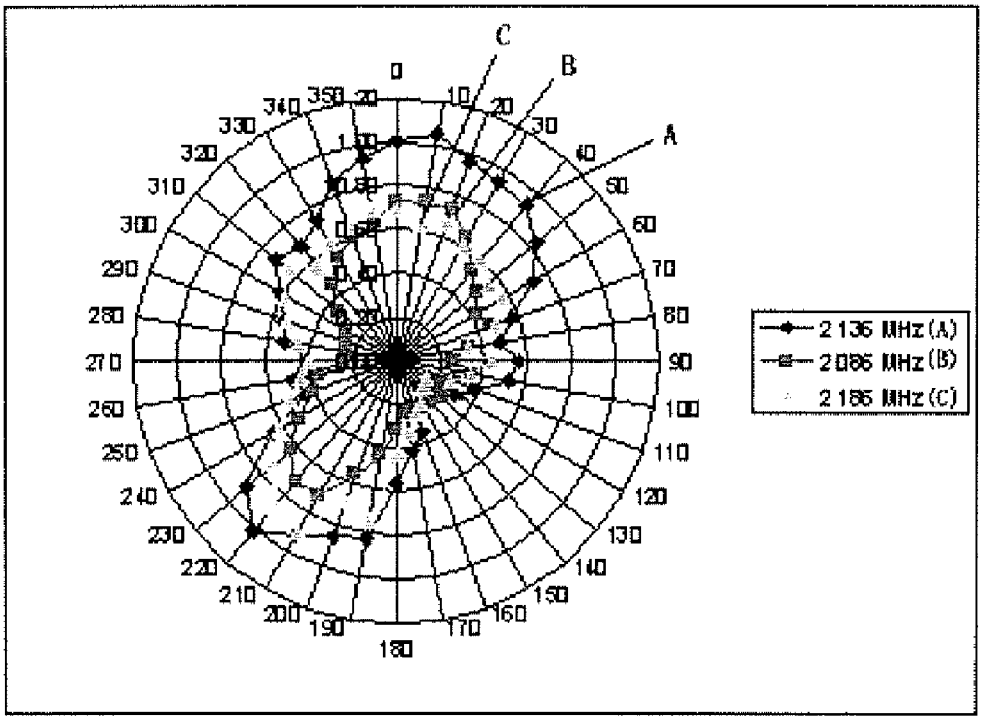

FIGS. 11*a* and 11*b* illustrate measurements of the antenna radiation pattern in the horizontal and in the vertical plane of FIG. 8.

Figure 12:
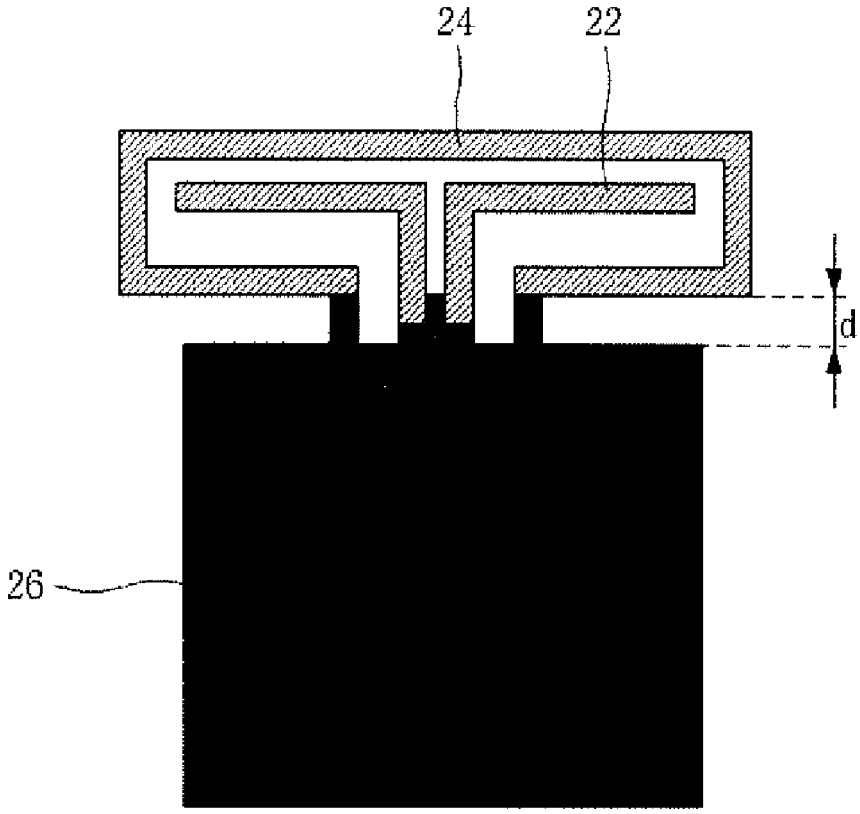

FIG. 12 schematically shows a radiator combining a dipole and a loop with ground according to the third embodiment of the invention.

Figure 13:
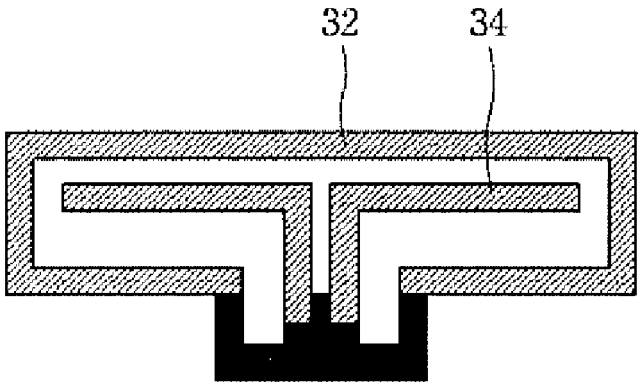

FIG. 13 schematically shows a radiator combining a dipole and a loop without ground according to the forth embodiment of the invention.

Figure 14:
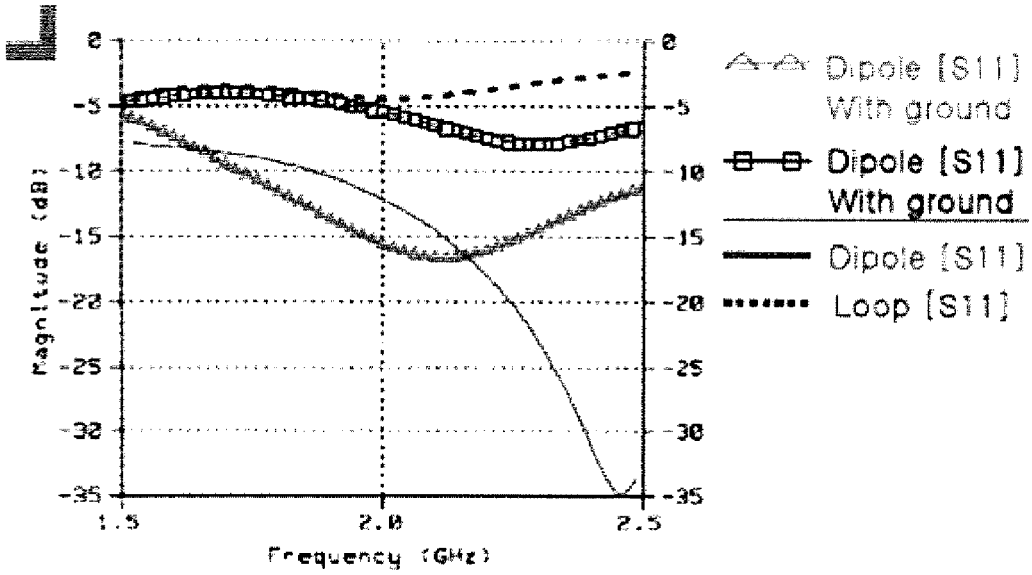

FIG. 14 illustrates characteristic of antenna matching of FIGS. 12 and 13.

Figure 15:
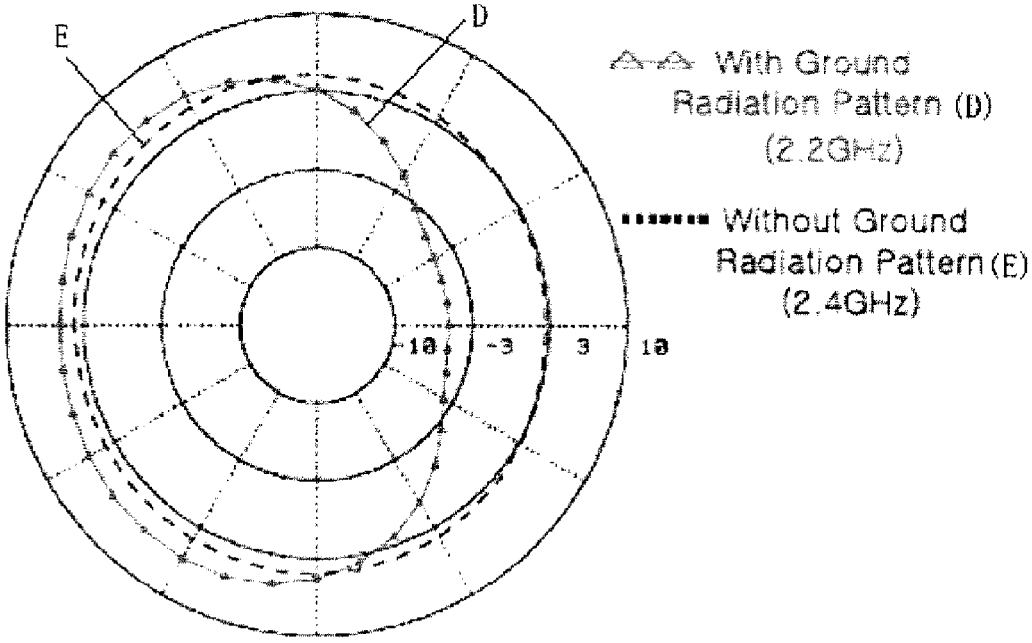

FIG. 15 illustrates measurements of the antenna radiation pattern with ground and without ground of FIGS. 12 and 13.

Figure 16:
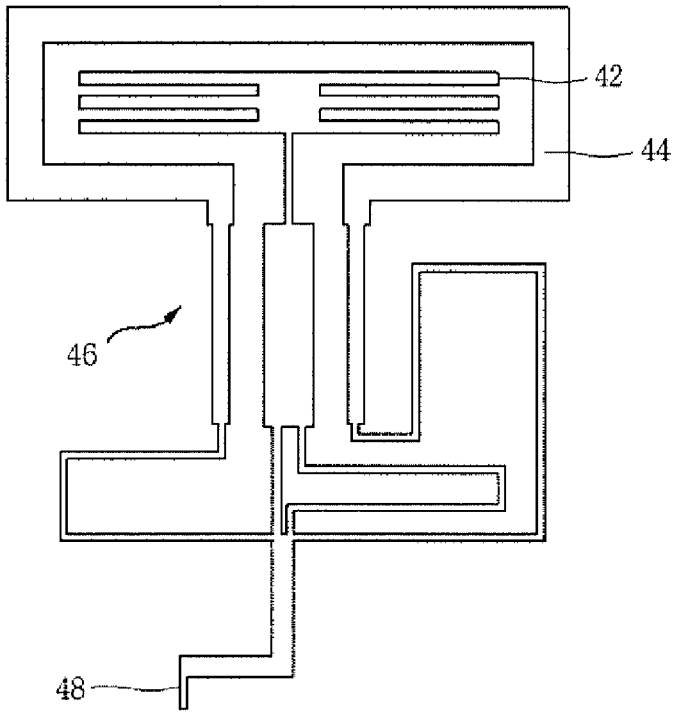

FIG. 16 schematically shows a radiator combining a dipole and a loop according to the fifth embodiment of the invention.

Figure 17:
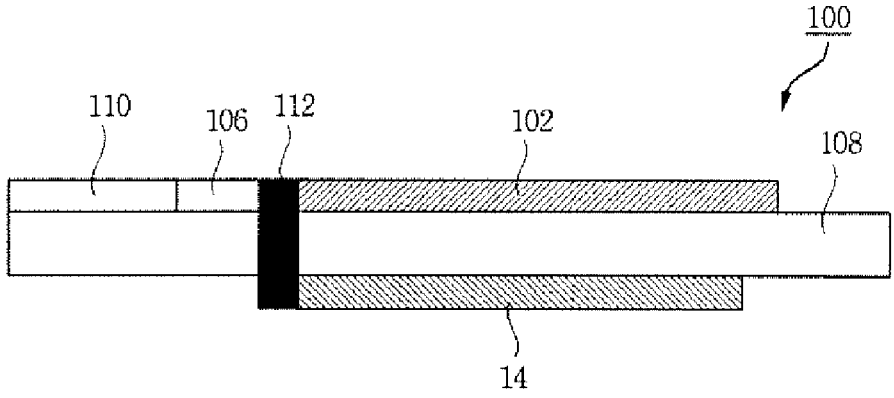

FIG. 17 is a cross-sectional view of an antenna according to the sixth embodiment of the invention.

Figure 18A:
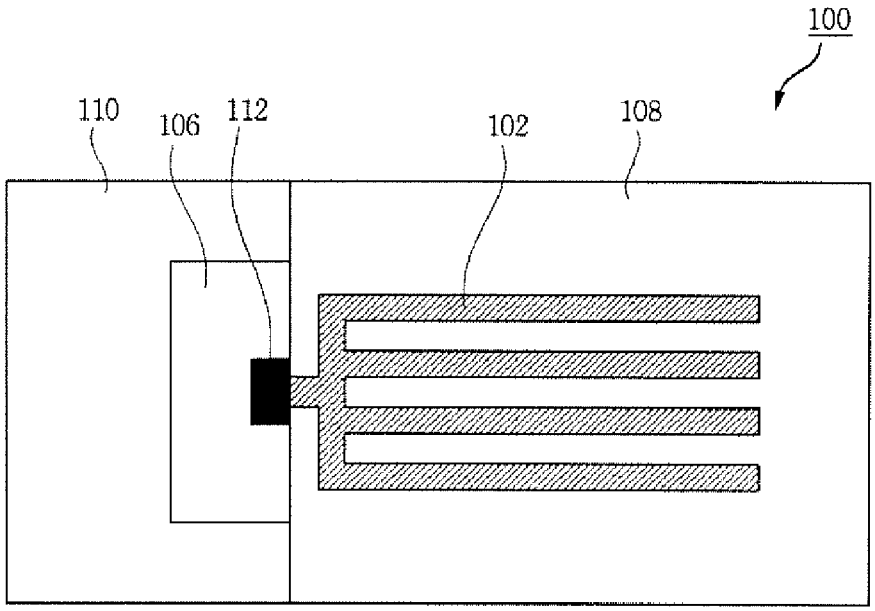
Figure 18B:
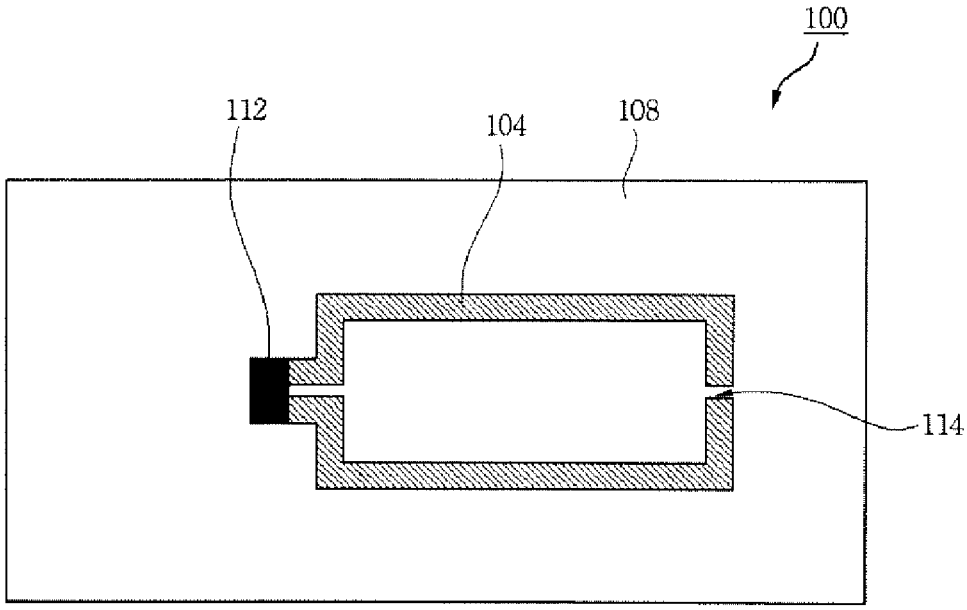

FIG. 18*a* is one side view of the antenna of FIGS. 17 and FIG. 18*b* is other side view of the antenna of FIG. 17.

Figure 19:
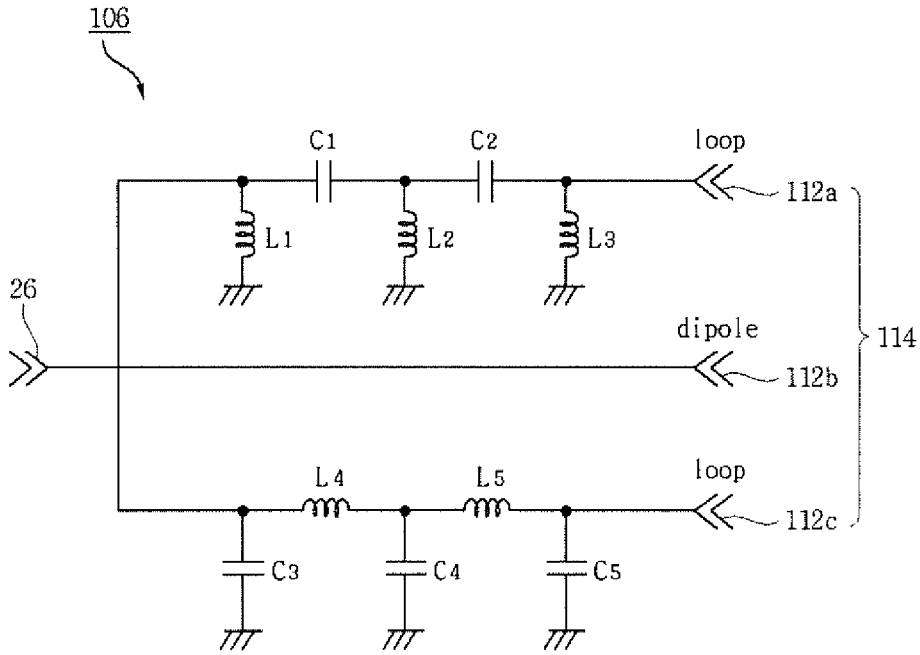

FIG. 19 is a circuit diagram of the matching circuit of FIG. 17.

Figure 20A:
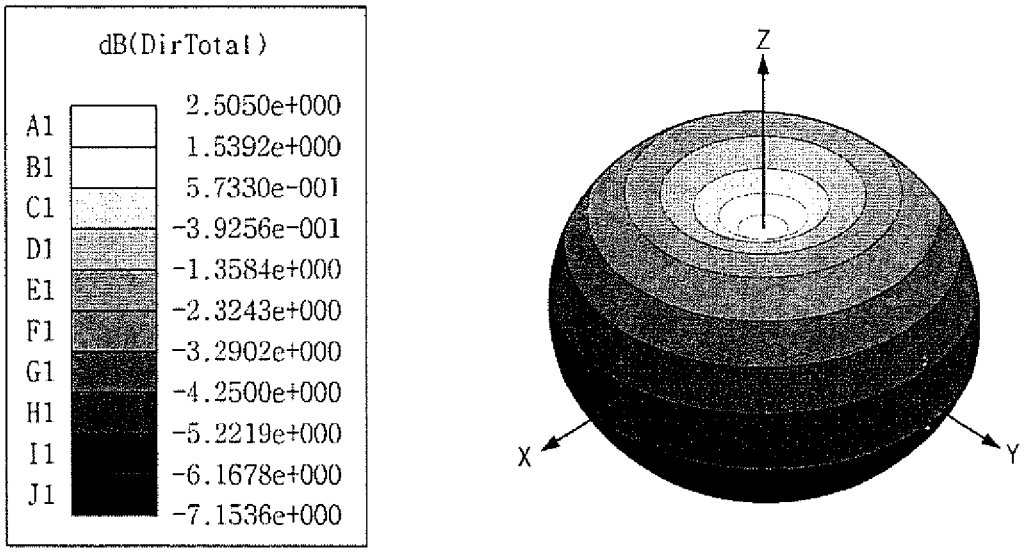
Figure 20B:
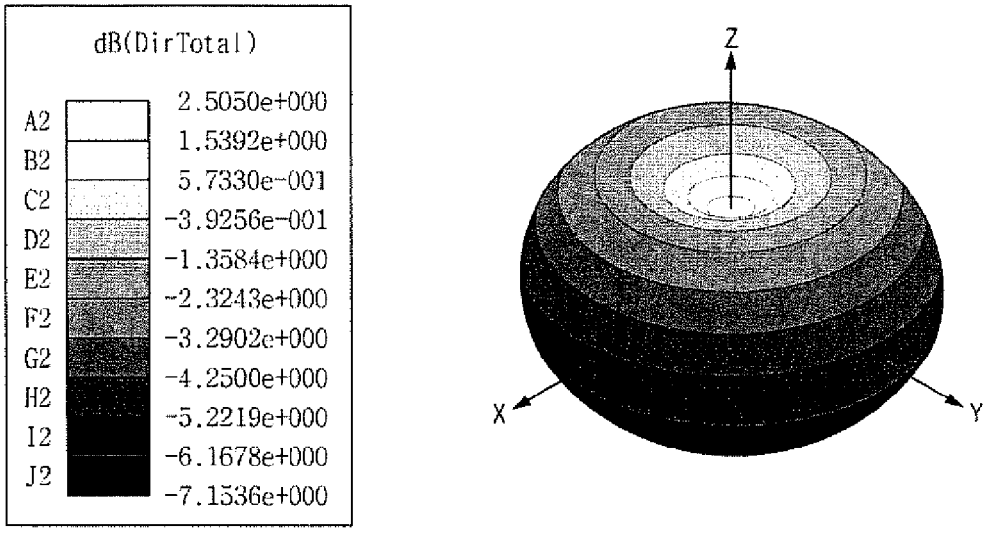

FIGS. 20*a* and 20*b* illustrate measurements of the antenna radiation pattern in case the currents are provided for a single dipole or a single loop of the antenna respectively.

Figure 21:
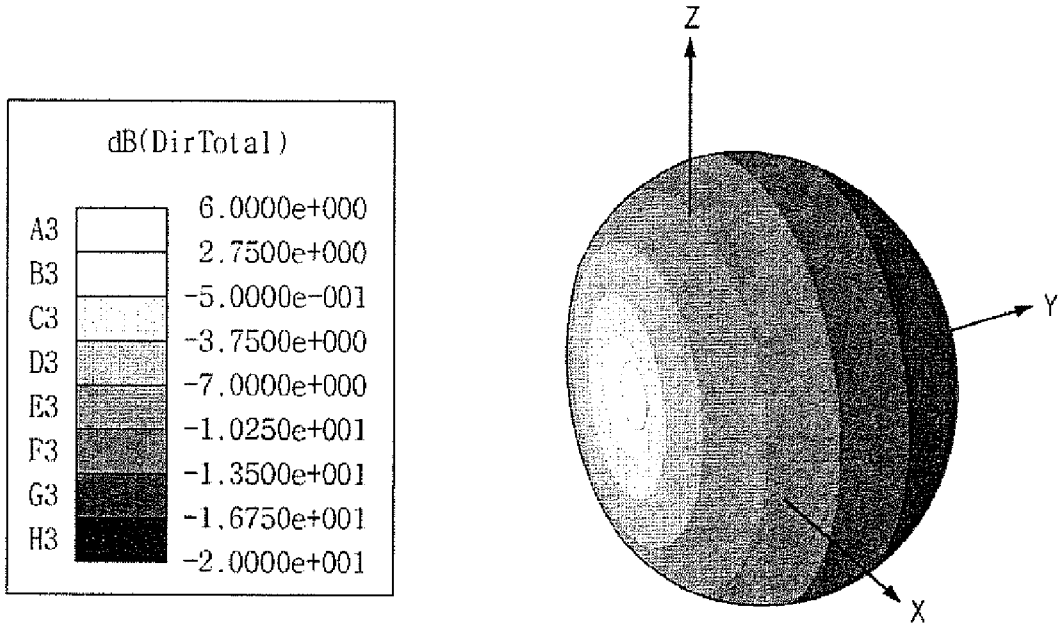

FIG. 21 illustrates measurement of the antenna radiation pattern in case the currents with $90°_{\Gamma}$ phase difference are provided for both a single dipole and a single loop of the antenna simultaneously.

Figure 22:
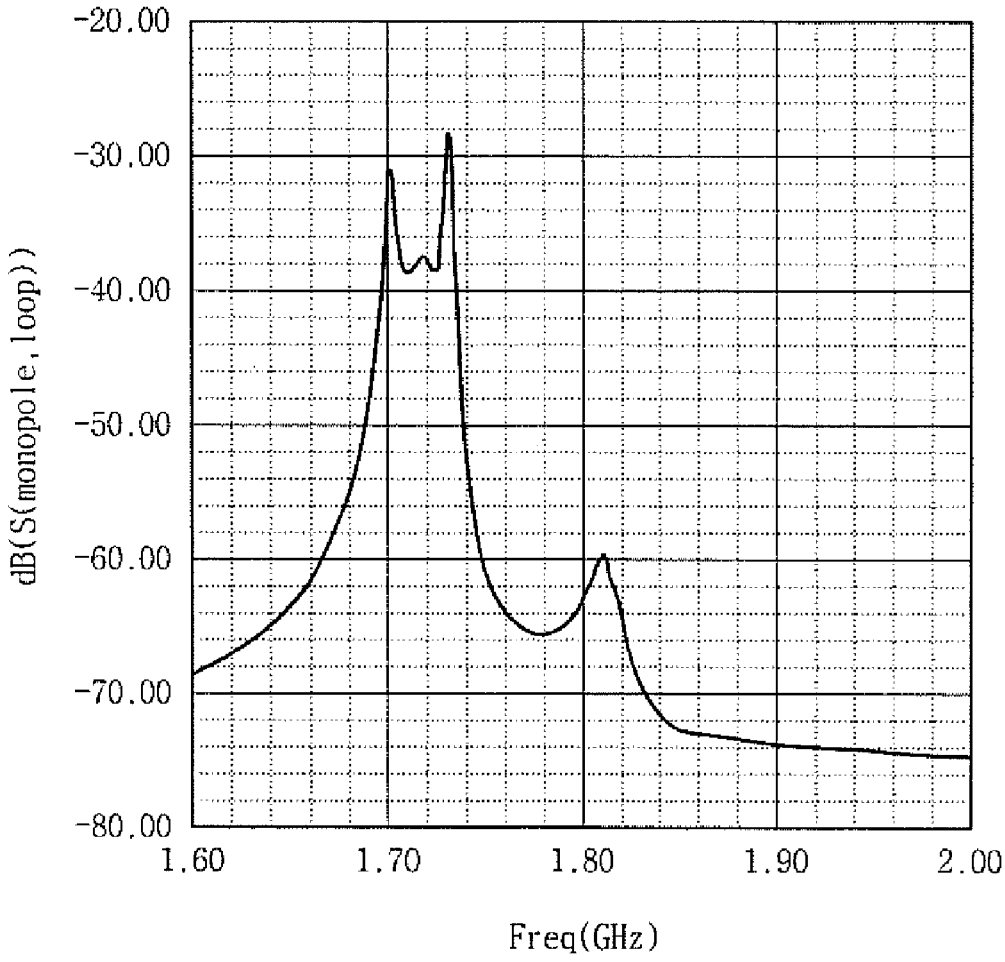

FIG. 22 shows the coupling characteristic of the dipole and the loop of the antenna.

Figure 23:
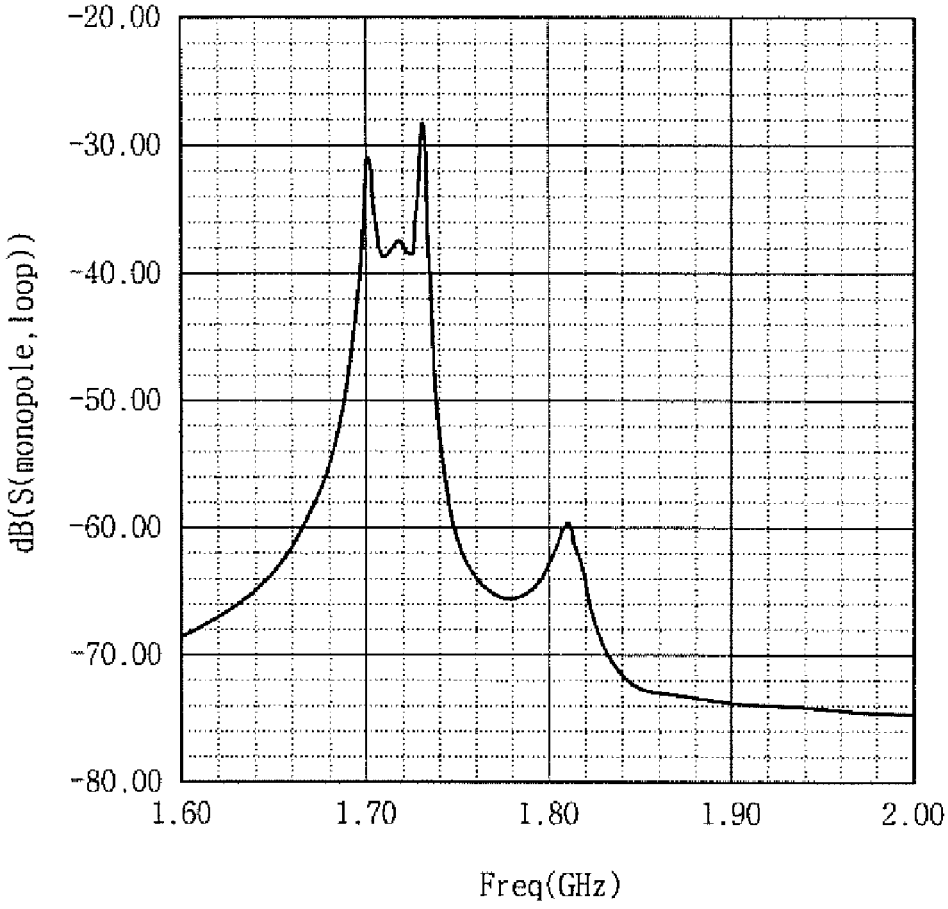

FIG. 23 shows the radiation resistance for the dipole and the loop of the antenna.

Figure 24:
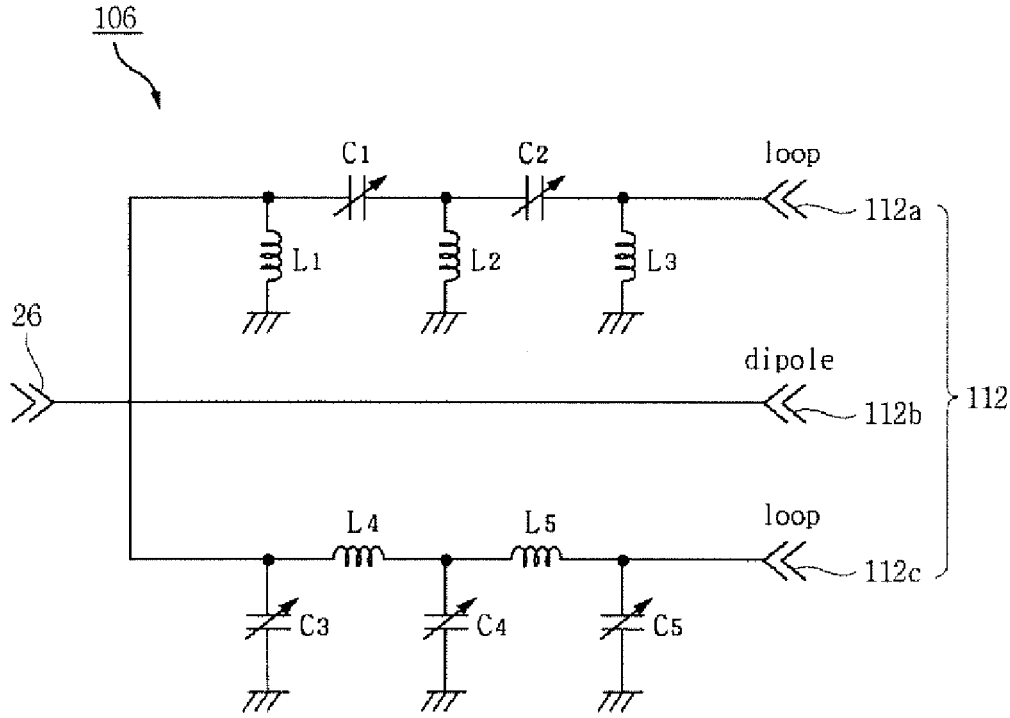

FIG. 24 is a circuit diagram of the other matching circuit of FIG. 17.

Figure 25:
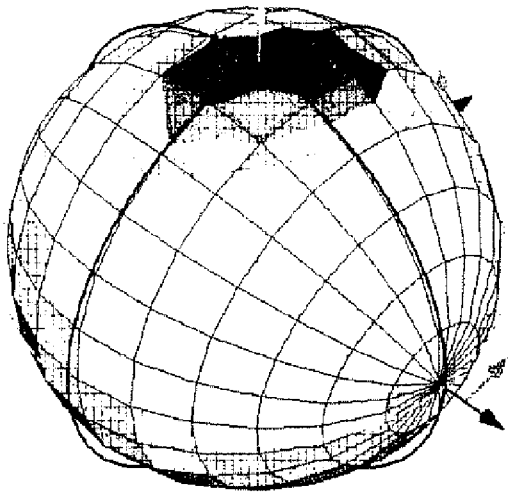

FIG. 25 illustrates all-directed radiation pattern without a null point for the antenna.

DETAILED DESCRIPTION

Hereinafter, the embodiments of the present invention will be described in detail with reference to the accompanying drawings. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms.

The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures.

In recent years, considerable attention has been given to studying fields in the near zone (Fresnel zone) of a radiating dipole, especially antennas whose dimensions are much smaller than the radiation wavelength.

The distribution of electric and magnetic fields in the Fresnel zone differs substantially from the field distribution in the far zone (Fraunhofer zone), the latter being described by the polar diagram of an antenna. Therefore, the field distribution in the Fresnel zone of a radiator whose dimensions are smaller than the radiation wavelength requires a dedicated study. A radiator such that all of its dimensions are much smaller than the radiation wavelength will be referred to here as a microradiator.

For a microradiator, one can consider an individual dipole or a loop. Of particular interest is a device combining a small dipole and a small loop. Such a combination makes it possible to obtain directed radiation without using superdirectivity effects. In the far zone of radiation, a combination of a dipole and a loop ensures a polar diagram in the form of a cardioid featuring zero radiation in the direction of the main ray of the antenna being considered. It is of particular interest to clarify the question of how the strengths of the electric and magnetic fields of such a pair of radiators change in the near zone (Fresnel zone).

Embodiment 1

Let us consider an electric dipole of length $l \ll \lambda$ and a circular loop of radius $a \gg \lambda$.

Figure 1:
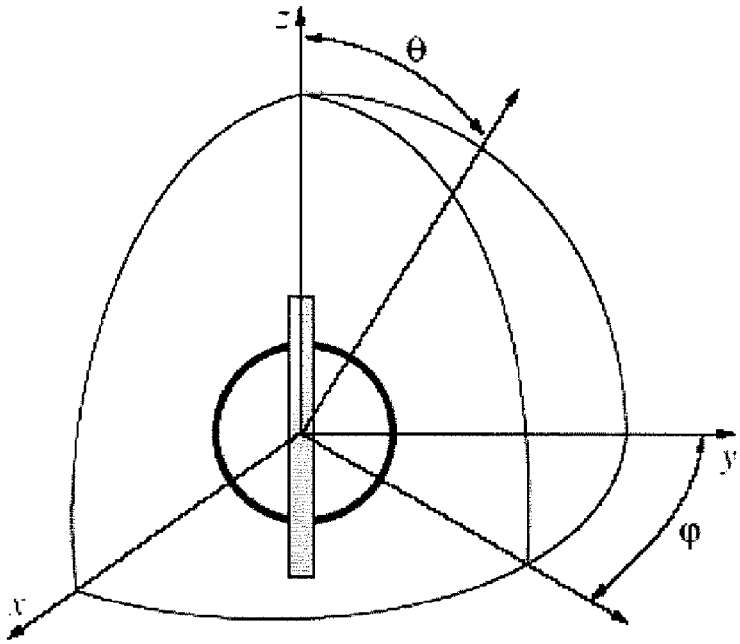
FIG. 1 schematically shows the arrangement of a dipole and a loop of a microradiator in spherical coordinates according to the first embodiment of the invention.

FIG. 1 shows the arrangement of the radiators with respect to the chosen coordinate frame. Traditionally, fields generated by a loop are determined for a loop lying in the xy plane. In our case, the loop lies in the yz plane. By using known relations for going over from the radiating current to the vector potential and the field-strength vectors, we obtain the strengths of magnetic and electric fields of an electric dipole aligned with the z axis and a loop lying in the yz plane.

For an electric dipole of length l, we have $$H_\varphi(\theta.r) = I_{dip}\frac{ik/\sin\theta}{4\pi r}\left(1-\frac{1}{ikr}\right)e^{-ikr}$$
$$H_\theta(\theta.r) = 0. \tag{1}$$
$$H_r(\theta, r) = 0.$$

$$E_r(\theta, r) = Z_0 I_{dip}\frac{l\cos\theta}{2\pi r^2}\left(1+\frac{1}{ikr}\right)e^{-ikr},$$
$$E_\theta(\theta.r) = Z_0 I_{dip}\frac{ik/\sin\theta}{4\pi r}\left(1-\frac{1}{ikr}-\frac{1}{(kr)^2}\right)e^{-ikr}. \tag{2}$$
$$E_\varphi(\theta.r) = 0.$$

For a magnetic dipole represented by a loop of radius a, the results are $$H_\varphi(\varphi, \theta, r) = I_{loop}\frac{a^4\sin\varphi}{4r^3}(-1-k^2r^2-ikr)e^{-ikt}.$$
$$H_\theta(\varphi, \theta, r) = I_{loop}\frac{a^2\cos\varphi\cos\theta}{4r^3}(1-k^2r^2+ikr)e^{-ikr}. \tag{3}$$

-continued $$H_r(\varphi, \theta, r) = 0.$$
$$E_\theta(\varphi, \theta, r) = Z_0 I_{loop}\frac{(ka)^2}{4r}\left(1+\frac{1}{ikr}\right)\sin\varphi e^{-ikr}.$$
$$E(\varphi, \theta, r) = Z_0 I_{loop}\frac{-(ka)^2}{4r}\left(1+\frac{1}{ikr}\right)\cos\varphi\cos\theta e^{-ikr}. \tag{4}$$
$$E_r(\varphi, \theta, r) = 0.$$

Here, we have used the following notation: r is the distance between the center of radiation and the point of observation and $I_{dip}$ and $I_{loop}$ are the currents in the dipole and the loop, respectively. The wave number is $$k = \frac{2\pi}{\lambda}. \tag{5}$$

where λ is the wavelength in a free space.

Let us find the sum of the fields radiated by the dipole and the loop arranged in such a way that their phase centers coincide and that the phase difference between the dipole and loop currents is 90°. We have $$E_\theta(\varphi, \theta, r) = Z_0\frac{1}{r}\left[A\rho\left(1+\frac{1}{ikr}\right)\cos\varphi + B\rho\left(1+\frac{1}{ikr}-\frac{1}{(kr)^2}\right)\sin\theta\right]e^{-ikr}, \tag{6}$$

$$E_\varphi(\varphi, \theta, r) = \frac{1}{r}\left[A\rho\left(1-\frac{1}{ikr}\right)\sin\varphi\cos\theta\right]e^{-ikr}. \tag{7}$$

$$H_\theta(\varphi, \theta, r) = -\frac{1}{r}\left[A\rho\left(1+\frac{1}{ikr}-\frac{1}{(kr)^2}\right)\times\sin\varphi\cos\theta\right]e^{-ikr}, \tag{8}$$

$$H_\varphi(\varphi, \theta, r) = \frac{1}{r}\left[A\rho\left(1+\frac{1}{ikr}-\frac{1}{(kr)^2}\right)\cos\varphi + B\rho\left(1+\frac{1}{ikr}\right)\sin\theta\right]e^{-ikr}. \tag{9}$$

Here, we have used the following notation:

$$A\rho = I_{loop}\frac{(ka)^2}{4}, \quad B\rho = I_{dip}\frac{kl}{4\pi}. \tag{10}$$

Figure 2:
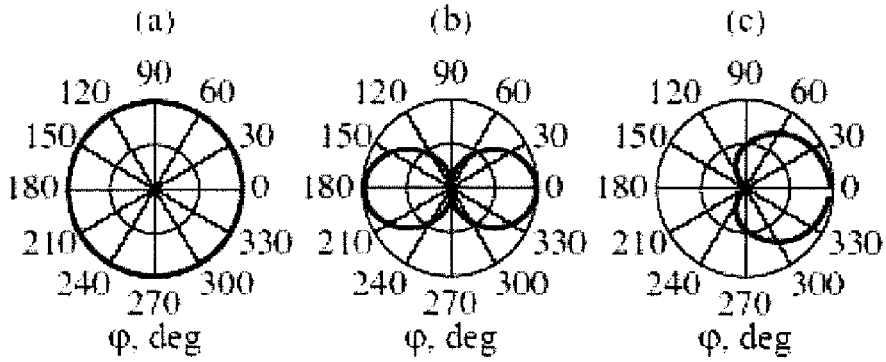
FIG. 2 shows Polar diagrams in the far region for microradiators of three types. (a) dipole, (b) loop, and (c) dipole-loop pair.

We note that the factors Aρ and Bρ have the dimensions of a current. The table 1 gives the sets of coefficients A and B for various microradiator types. If the value of ρ=0.01779 A is chosen, the total active power radiated by each of the aforementioned radiator is 1 W. The polar diagrams of each of the microradiators in the far zone (kr>>1) are shown in FIG. 2 for the equatorial plane (θ=π/2).

TABLE 1

Microradiator type

| Coefficients used | | Microradiator type |
|---|---|---|
| $A = \sqrt{2}$ | $B = 0$ | Loop |
| $A = 0$ | $B = \sqrt{2}$ | Dipole |
| $A = 1$ | $B = 1$ | Loop-dipole pair |

Complex Flux of the Poynting Vector Through a Spherical Surface Surrounding a Microradiator Let us consider the flux of the Poynting vector through a sphere of radius r surrounding a microradiator occurring in a free space. We have $$P_0(r) = \int_0^{2\pi}\int_0^{\pi}[E_\theta(\varphi,\theta,r)H_\varphi^*(\varphi,\theta,r) - E_\varphi(\varphi,\theta,r)H_\theta^*(\varphi,\theta,r)]r^2\sin\theta d\theta\, d\varphi, \tag{11}$$

where asterisks denote complex conjugation.

Figure 3:
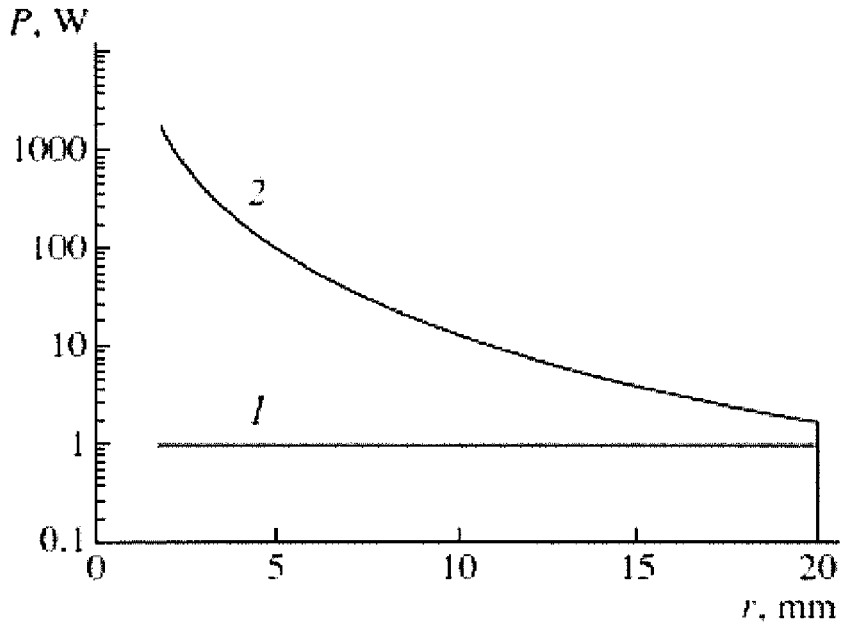
FIG. 3 shows dependence of the (1) real and (2) imaginary parts of the Poynting vector flux on the distance r to the radiator center. The imaginary part of the flux is positive for the loop, but it is negative for the dipole. The respective two dependences coincide in magnitude.

The dependence of the real and imaginary parts of the Poynting vector flux on the radius r is shown in FIG. 3 according to formula (11). We note that $Re[P_0(r)]$ is formally a function of r, but, in fact, it does not depend on r. This is a consequence of the energy-conservation law and confirms the validity of the analytic expressions for $E_\Theta(\phi, \theta, r)$ and $H_\Psi(\phi, \theta, r)$. For kr<0.1, the imaginary part of the Poynting flux vector, $Im[P_0(r)]$, for an individual dipole or an individual loop exceeds its real part; as one approaches the center of radiation, the former may exceed the latter by several orders of magnitude.

This suggests that a large amount of pulsed electromagnetic-field energy is accumulated in the antenna whose dimensions are much smaller than the radiation wavelength. At the same time, the imaginary part of the Poynting flux vector, $Im[P_0(r)]$, for kr<0.1 in the case of a dipole-loop pair is close to zero. This is likely to indicate that the reactive energies of the dipole and the loop compensate each other.

Let us consider the dissipation of electromagnetic energy by an absorbing object that has the shape of asphere and is placed in the Fresnel zone of the microradiator being considered (see FIG. 4(*a*)). The absorbing object covers the radiation flux within the cone of opening angle 4α, where $$\alpha = \frac{1}{2}\arcsin\left(\frac{r}{R+r}\right). \tag{12}$$

Here, R is the radius of the absorbing ball, while r is the distance from the center of the radiator to the surface of the ball.

For the sake of definiteness, we assume that the relative magnetic permeability of the ball is μr=1 and that its dielectric characteristics at a frequency of 1-2 GHz correspond to the values of εm≅50 and σm≅1(Ωm)−1.

The chosen parameters correspond to the properties of biological objects. In order to simplify the evaluation of relevant integrals, we will calculate the absorption by using a simplified scheme that is illustrated in FIG. 4(*b*). In isolating the central part of the cone, we have considered that, in the external part of the cone the lines of force of the spherical wave radiated by the microradiator are orthogonal to the surface of the absorbing ball and are strongly weakened at the dielectric characteristics specified above. In the central part of the cone, the lines of force of the spherical wave are tangential to the surface of the ball and are therefore continuous at the interface of the free space and the absorbing ball.

For kr<<1, the interaction of the electric field with the absorbing object is of a quasistatic character. In view of this, it would be illegitimate to consider the presence of incident and reflected waves in spherical coordinates at a distance from the radiator center much shorter than the radiation wavelength. We now consider a sphere of radius r surrounding the microradiator. At the surface of the sphere, one can introduce the characteristic impedance $Z_{fresn}$ in the Fresnel zone as the ratio of $E_\Theta(\phi, \theta, r)$ to $H_\Psi(\phi, \theta, r)$ at a specific small distance r and arbitrary angles φ and θ. For kr<1, the characteristic impedance $Z_{fresn}$ becomes a pure imaginary quantity whose modulus may exceed $Z_0$ substantially.

Upon averaging, we can set $Z_{fresn}=2Z_0$ with an acceptable degree of accuracy. We assume that, in accordance with FIG. 4(*b*), the cone of opening angle 4α cuts, from the sphere surrounding the microradiator, a spherical segment whose surface impedance is determined by the properties of the absorbing object, $$Z_{SUR} = \sqrt{\frac{i\omega\mu_0}{\sigma_m - i\omega\varepsilon_0\varepsilon_m}}. \tag{13}$$

where $\epsilon_0$ and $\mu_0$ are, respectively, the electric permittivity of the free space and its magnetic permeability and $\sigma_m$ and $\epsilon_m$ are, respectively, the conductivity and the relative dielectric permittivity of the absorbing-object material.

Let us consider the question of how the lines of force of magnetic and electric fields penetrate into an absorbing object. Within the cone of opening angle 4α, the lines of force of the magnetic field are tangential to the surface of the object; from this and from the known boundary conditions, it follows that, at the surface of the object, they generate a surface current that is numerically equal to the magnetic-field strength. Further, the irradiated ball surface, which is singled out by the cone of opening angle 4α, will be considered as a conducting segment surrounded by a weakly conducting medium.

In the quasistatic approximation, the electric field causes a polarization of this segment, this leading to the weakening of the field strength at its surface. To an acceptable degree of precision, we can assume that the spherical segment cut by the cone of opening angle 4α can be replaced by a plane disk FIG. 5 displays the distribution of the lines of force of the electric field on a plane conducting surface having the conductivity $\sigma^{(1)}_{SUR}$ and containing an inserted disk of conductivity $\sigma^{(2)}_{SUR}$. By solving Laplace's equation, one can show that the field strength in the disk plane is uniform and is given by $$E_{in} = \frac{2E_{out}}{1 + \sigma^{(2)}_{SUR}/\sigma^{(1)}_{SUR}}. \tag{14}$$

The above considerations make it possible to calculate the power that is absorbed by an absorbing object situated near a microradiator. We have $$P_{abs}(\varphi_0, \theta_0, r) = \frac{\pi}{4}\int_{\varphi_0-\alpha}^{\varphi_0-\alpha}\int_{\theta_0-\alpha}^{\theta_0-\alpha} S(\varphi,\theta,r)\sin\theta d\theta d\varphi, \tag{15}$$

Where $$S(\varphi, \theta, r) = \frac{|H_\theta(\varphi, \theta, r)|^2 - |H_\varphi(\varphi, \theta, r)|^2}{2}\mathrm{Re}(Z_{SUR}) + \frac{|2E_\theta(\varphi, \theta, r)|^2 + |2E_\varphi(\varphi, \theta, r)|^2}{2\left|1 - \frac{2Z_0}{Z_{SUR}}\right|^2}\mathrm{Re}(Z_{SUR}):$$

$\phi_0$ and $\theta_0$ are the angles that, in the system of spherical coordinates introduced above, determine the direction from the center of the microradiator to the irradiated segment of the absorbing object; and the factor $\pi/4$ reflects the ratio of the area of the circle used in the model to the area of the square specified by the limits of integration in (15).

The ratio of the power absorbed by the absorbing object to the total power radiated by the microradiator as a function of the distance between the radiator center and the surface of the absorbing object.

We have $$\kappa(\varphi_0, \theta_0, r) = \frac{P_{\mathrm{abs}}(\varphi_0, \theta_0, r)}{Re[P_0(r)] - P_{\mathrm{abs}}(\varphi_0, \theta_0, r)}. \quad (16)$$

The parameter $\kappa(\phi_0, \theta_0, r)$ is known as the specific absorption coefficient. We note that, at a small distance from the microradiator to the absorbing-object surface, it may turn out that $P_{abs}(\phi_0, \theta_0, r) > \mathrm{Re}[P_0(r)]$. In this case, the microradiator radiation resistance grows owing to a strong coupling to the absorbing object.

FIG. 6 shows the specific absorption coefficient as a function of the distance between the microradiator and the absorbing-object surface at $\theta_0=\pi/2$ for three microradiator types considered in the present study: a dipole-loop pair at $\phi_0$=(1)0 and (2) $\pi$ and (3) a dipole or a loop. For a dipole-loop pair, the specific absorption coefficient is given for two directions corresponding to the maximum and the zero of the relevant cardioid ($\phi_0$=0 and $\pi$, respectively).

From the graph in FIG. 6, one can see that, at the distance between the radiator center and the absorbing object surface on the order of 1-3 mm, the bulk of the radiated power goes to the absorbing object. With increasing distance, the absorption decreases sharply, falling below 1% even at a distance as small as 10 mm. The relative power absorbed by a phantom mimicking the head of a human being was measured at a frequency of 1800 MHz, the distance from the radiator center to the outer surface of the absorbing object being taken to be 4.7 mm. The measurement showed that the experimental phantom absorbs 24% of the total radiated power. The point corresponding to this measurement is shown in FIG. 6.

We will now proceed to discuss some special features of the distribution of electric and magnetic fields in the near zone of microradiators. First of all, we will consider the dependence of the electric field and magnetic field strengths on the azimuthal angle $\phi_0$ in the equatorial plane $\phi_0=\pi/2$ of a dipole-loop pair. In order to obtain an integrated characteristic of the dependence being discussed, it is convenient to consider the angular dependence of the specific absorption coefficient at various distances between the microradiator center and the absorbing-object surface.

FIG. 7 shows $\kappa(\phi_0, \theta_0, r)$ as a function of $\phi_0$ at $\theta_0=\pi/2$ for three different distances. At $r=\lambda/2$, $\kappa(\phi_0, \theta_0, r)$ is the square of the function describing the cardioid—that is, it replicates the polar diagram of the microradiator in the far zone. At $r=\lambda/8$, the ratio of $\kappa(0, \theta_0, r)$ to $\kappa(\pi, \theta_0, r)$ is approximately equal to 3, while, at $r=\lambda/15$, this ratio is close to unity.

The diagrams in FIG. 7 show how strong the distribution of the field in the near zone of a microradiator differs from the respective distribution in its far zone. For a single dipole or a single loop, the ratio of $\kappa(0, \theta_0, r)$ to $\kappa(\pi, \theta_0, r)$ is equal to unity at any value of r. Thus, we see that, for $r \leqq \lambda/15$, the fraction of the power absorbed in the absorbing object takes the same value for a loop, a dipole, and a dipole-loop pair, although the polar diagram of the pair in the far zone has the form of a cardioid.

At first glance, it therefore seems that, in what is concerned with the absorption of the power of ultrahighfrequency radiation in a closely lying absorbing object, a dipole-loop pair does not have advantages over a single dipole or a single loop. However, we note that the gain factor for a dipole or a loop such that either has dimensions much smaller than the radiation wavelength is G=1.5, while the gain factor for a dipole-loop pair is G=3 [4, 5]. This means that, if the microradiators used generate identical field strengths in the far zone, the absorbed power in the absorbing object is two times smaller in case of a dipole-loop pair than in the case of a single loop or a single dipole.

The imaginary part of the Poynting vector flux through a sphere surrounding a microradiator grows extremely fast as the radius of the sphere decreases. It can be shown that, for a single dipole or a single loop, the ratio of the imaginary and real parts of the Poynting vector flux determines the quality factor of the radiator being considered. By way of example, we indicate that, for a loop of radius a=10 mm, the radiation resistance at a frequency of 2 GHz is 6Ω, while its reactive resistance under the same conditions is about 150Ω, which corresponds to a quality factor of Q=25. From FIG. 3*b*, we find that, at r=10 mm, $\mathrm{Im}[P_0(r)] \cong 15$, while $\mathrm{Re}[P_0(r)]=1$. Thus, we see that, if r is equal to the radiator size (r=a), then the ratio of $\mathrm{Im}[P_0(r)]$ to $\mathrm{Re}[P_0(r)]$ is on the same order of magnitude as the microradiator quality factor. The distinction between these quantities can be explained by the fact that part of the reactive energy is stored in the field components $Er(\theta, r)$ and $Hr(\theta, r)$, which do not take part in the formation of the Poynting vector flux.

The explanation for the extreme smallness of the imaginary part of the Poynting vector flux for a microradiator in the form of a dipole-loop pair is expected to be much more involved. The absence of the imaginary part of the flux does not mean that the radiator quality factor is close to zero. The point is that the imaginary part of the flux vanishes in the case of the exact equality of the amplitudes of the currents in the dipole and in the loop (A=B in our case). Only at a fixed frequency is it possible to ensure the equality of the amplitudes of the currents in the reactive loads, a dipole and a loop, by means of corresponding matching devices. In other words, the problem of the quality factor for the system in question becomes dependent on the characteristic of the frequency dependence of the dipole and loop supply circuits.

We have considered special features of the distribution of the electric and magnetic fields in the Fresnel zone of microradiators represented by a dipole, a loop, or a dipole-loop air, whose polar diagram in the far zone has the form of a cardioid. The main conclusion is that the ideas of the field distribution (polar diagram) in the far zone cannot be applied to the properties of the fields in the Fresnel zone. For the radiators considered here, the special features of the Fresnel zone manifest themselves within a sphere of radius $\lambda/8$, naturally in the case where the dimensions of the radiators do not exceed the radius of this sphere. If a microradiator is situated within a distance of several millimeters from the surface of an absorbing object whose electrodynamic properties are close to those of biological media, the fraction of the absorbed power (specific absorption coefficient) at a frequency of 1-2 GHz can be as high as 20-30%.

Embodiment 2

FIG. 8 schematically shows a radiator combining a dipole and a loop according to the second embodiment of the invention.

Referring to FIG. 8, the antenna 10 according to the second embodiment of the invention is a combination of a dipole 12 and a loop 14 performed as a thin film planar integrated circuit on a dielectric substrate. The dipole 12 and the loop 14 are placed in such a form that the radiation centers of them coincides. The dipole 12 is formed as a strip structure, which is transparent for the microwave magnetic field and closed for the electric field of the dipole 12. Penetrability of the dipole 12 for the magnetic field makes it is possible to use the whole area of the loop 14 and provide the larger loop radiation resistance. The strip structure of the dipole 12 provides the large enough capacitance of the dipole 12, which is followed by realization of the wide frequency range of the antenna 10. The size of both the dipole 12 and the loop 14 are sufficiently smaller as the wavelength used in the system. Relative position of the dipole 12 and the loop 14 is shown in FIG. 8.

The distribution of phases at the dipole and loop inputs is presented in FIG. 8. The phase difference of the dipole 12 and the loop 14 is 90°. The phase difference of two port of the dipole 12 is 180°. Likewise, The phase difference of two port of the loop 14 is 180°. As a result, Such a phase distribution provides the radiation pattern of the system in the form of a cardioid.

A matching circuit supports the required current amplitudes in the dipole 12 and in the loop 14. The matching circuit is designed to provide the equal power radiated by both the dipole 12 and the loop 14. The symmetry of the antenna 10 provides the zero mutual influence between currents of the dipole 12 and the loop 14 ($I_4=-I_1$, $I_3=-I_2$, $I_2=I_1e^{i\pi/2}$), which make it possible to match independently the input impedance of the both radiators 12, 14.

The directivity of the antenna 10 in the form of the dipole and the loop combination D=3, which is twice higher, than the directivity of a single dipole or a single loop. Averaging the microwave power received by a cell phone or a mobile terminal through the different virtual channels shows that the effective radiation pattern of the antenna 10 in the form of the dipole and the loop combination is isotropic and the effectiveness of the antenna 10 is twice higher, than the effectiveness of a single dipole or a single loop Matching of the input impedance of the dipole 12 and the loop 14 are realized by a planar microwave integrated circuit in the form of microstrip lines or planar lumped L and C components.

FIGS. 9*a* and 9*b* schematically shows layout of the antenna and matching circuit according to the second embodiment of the invention.

Referring to FIG. 9*a*, the planar integrated circuit 16 on the alumina substrate 18 is designed and manufactured. The size of the substrate is 60×48 mm. The part of the substrate 18 has copper ground plane for one side and the other part was free of metallization. On the free part of the substrate 18 the dipole 12 and the loop 14 are patterned and the other part is used for designing the matching circuits 16 as a microstrip integrated circuit.

Referring to FIG. 9*b*, on the free part of the substrate 18 the dipole 12 and the loop 14 are patterned and the other part is used for designing the PCB 20. And the matching circuits 18 as a microstrip integrated circuit are designed between them.

FIGS. 10*a* and 10*b* presents the performance of antenna matching. FIG. 10*a* presents the result of full-wave (electromagnetic) simulation. One can see the current distribution between the four inputs of the dipole 12 and the loop 14 and the inversion loss at the general input of the device. FIG. 10*b* presents the result of experimental measurement of the inversion loss (−12 dB). The reasonable matching was confirmed, but the frequency of the matching in simulation and experiment did not coincide.

FIGS. 11*a* and 11*b* illustrate measurements of the antenna radiation pattern in the horizontal plane and in the vertical plane.

The measured radiation pattern verifies predominantly the unidirectional radiation of the antenna. Unfortunately, we had not in our disposition a reflectionless room for the radiation pattern measurements. The distortion of the radiation pattern measured can be explained by the influence of the reflections from surrounding subjects.

Embodiment 3 and 4

FIG. 12 schematically shows a radiator combining a dipole and a loop with ground according to the third embodiment of the invention.

Referring to FIG. 12, on one part of the substrate not drawn the dipole 22 and the loop 24 are patterned and the other part is used for designing the PCB ground 26.

FIG. 13 schematically shows a radiator combining a dipole and a loop without ground according to the forth embodiment of the invention.

Referring to FIG. 13, on one part of the substrate not drawn the dipole 32 and the loop 34 are patterned. But on the other part of the substrater the PCB ground is not formed.

FIG. 14 illustrates characteristic of antenna matching of FIGS. 12 and 13. FIG. 15 illustrates measurements of the antenna radiation pattern with ground and without ground of FIGS. 12 and 13.

The size and the configuration of ground make it possible to change the radiation pattern and the return loss of radiators as shown in FIG. 14. For example, folder on/off and slide up/down change the ground condition, which make it possible to change the radiation pattern and the return loss of radiators sufficiently.

Embodiment 5

FIG. 16 schematically shows a radiator combining a dipole and a loop without ground according to the fifth embodiment of the invention.

Referring to FIG. 16, the planar integrated circuit on the alumina substrate is designed and manufactured. On the free part of the substrate the dipole 42 and the loop 44 are patterned and the other part is used for designing the feeder 46 as a microstrip integrated circuit. The size of the substrate is 60×48 mm. The size of the dipole 42 and the loop 44 is 16×48 mm and the size of the feeder 46 is 44×48 mm. The end of the feeder is the main port 48.

Embodiment 6

FIG. 17 is a cross-sectional view of an antenna according to the sixth embodiment of the invention.

FIG. 1*a* is one side view of the antenna of FIG. 17 and FIG. 18*b* is other side view of the antenna of FIG. 17.

Referring to FIG. 17, FIG. 18*a* and FIG. 18*b*, the antenna 100 is the combination of the dipole 102 and a loop 104 formed on the isolated substrate 108. In addition, the antenna 100 comprises a matching circuit 106 which supplies the dipole 102 and the loop 104 with electric currents, and a PCB 110 for an antenna comprising the matching circuit 106.

The dipole 102 and the loop 104 are formed as a thin film planar integrated circuit and on both sides of the substrate 108. For example, the dipole 102 is formed on the front side of the substrate 108. The loop 104 is formed on the rear side of the substrate 108 by thin film processing.

The radiation centers of both the dipole 102 and the loop 104 on both sides of the substrate 108 coincide almost or substantially.

The substrate 108 is an isolator, for example, aluminum. The size of the substrate 108 is, for example, 18 mm×55 mm. As described above, the dipole 102 and the loop 104 is formed on both sides of the substrate 108, which makes the antenna 100 a radiator. The size of the dipole 102 and the loop 104 is much smaller than a wavelength used by a system. For example, when total length of the substrate 108 is 55 mm, the radiation length, namely, the length of the longer side of the dipole 102 is 32 mm.

On the other hand, the length of the longer side of the loop 104 is 30 mm.

The PCB 110 for an antenna is formed on one part of the side of the substrate 108 on which the dipole 102 is formed. The matching circuit 106 is formed on other part of the same side. The matching circuit 106 is used for supplying the electric currents with different phases for the dipole 102 and the loop 104.

There are the plurality of connecting ports 112 electrically connecting the dipole and the loop with the matching circuit on the substrate 108. The connecting ports 112 functionally transmit electric currents supplied from the matching circuit 106 to the dipole 102 and the loop 104 respectively. The connecting ports 112 penetrate through the substrate 108 so that the electric currents are transmitted to the dipole 102 and the loop 104 which is formed on both sides of the substrate 108.

Referring to FIG. 18*a*, the dipole 102 is designed as a strip structure with four forks, so that The dipole 102 is transmissive to micromagnetic field and closed to electric field. The transmission for the dipole 102 to micromagnetic field allows the loop 104 to use its all area and its radiation resistance to be significantly increased. The strip structure of the dipole 102 provides sufficiently high capacitance for the antenna 100, which allows the antenna 100 to implement an optical frequency domain.

Referring to FIG. 18*b*, the loop 104 comprises the lumped capacitor 114 at the opposite of the connecting ports 112. The lumped capacitor 114 is used for inhibiting inductive reactance and making current distribution to be smooth. The input impedance matching of the dipole 102 and the loop 104 is implemented by the microstrip integrated circuit with the inductor and the capacitor lumped or the planar micro integrated circuit.

As the result, the radiation center of the dipole 102 and the loop 104 on both sides of the substrate 108 coincides almost or substantially. The electric currents with different phases is supplied for the dipole 102 and the loop 104 from the matching circuit 106 through the connecting ports 112, which allows the antenna 100 to send or receive the electric signal on air.

FIG. 19 is a circuit diagram of the matching circuit of FIG. 17.

Referring to FIG. 19, the matching circuit 106 supports the requested current amplitude in the dipole 102 and the loop 104. The phase difference of electric currents which the matching circuit 106 supplies for the dipole 102 and the loop 104 is 90°.

The matching circuit 106 is formed between the connecting ports 112*a* and 112*b* for a dipole which connects the matching circuit 106 and the dipole 102, and the connecting port 112*b* for a loop which connects the matching circuit 106 and the loop 104, and the connecting port 116 for a PCB which connects the matching circuit 106 and the PCU 110. The matching circuit 106 is an LC circuit which comprises five capacitors (C1 to C5) and five inductors (L1 to L5). These capacitors (C1 to C5) and inductors (L1 to L5) in the matching circuit 106 have specific capacitance and inductance in order to make the phase difference of the electric currents to be $90°_{\Gamma}$ by means of a circuit theory.

In addition, the matching circuit 106 is designed to provide the substantially equal power radiated by both the dipole 102 and the loop 104. The symmetry of the antenna 100 provides the zero mutual influence between currents of the dipole 102 and the loop 104, which make it possible to match independently the input impedance of both the dipole 102 and the loop 104.

The directivity of the antenna 100 in the form of the dipole-loop combination is twice higher than the directivity of a single dipole or a single loop. Averaging the microwave power received by a cell phone or a mobile terminal through the different virtual channels shows that the effective radiation pattern of the antenna 100 in the form of the dipole and the loop combination is isotropic and the effectiveness of the antenna 10 is twice higher than the effectiveness of a single dipole or a single loop.

FIGS. 20*a* and 20*b* illustrate measurements of the antenna radiation pattern in case the currents are provided for a single dipole or a single loop of the antenna respectively. FIG. 21 illustrates measurement of the antenna radiation pattern in case the currents with $90°_{\Gamma}$ phase difference are provided for both a single dipole and a single loop of the antenna simultaneously.

As you know in FIG. 21, in the far zone of radiation, the antenna 100 in the form of the dipole-loop combination ensures a polar diagram in the form of a cardioid featuring zero radiation in the direction of the main ray of the antenna being considered. Such a combination makes it possible to obtain directed radiation without using superdirectivity effects.

FIG. 22 shows the coupling characteristic of the dipole and the loop of the antenna. FIG. 23 shows the radiation resistance for the dipole and the loop of the antenna.

Referring to FIG. 22, the parameter S12 (db value of output signal amplitude for input signal amplitude) of the antenna 100 in the form of the dipole-loop combination indicated less than −30 db at 1.7-1.8 GHz, namely, the communication bandwidth for the European mobile communication terminal. It is said that the matching of the dipole 102 and the loop 104 is very good.

Referring to FIG. 23, the radiation resistance for the dipole 102 and the loop 104 of the antenna 100 is 20Ω at 1.7-1.8 GHz. This radiation resistance for the dipole 102 and the loop 104 of the antenna 100 results in the good match with the input resistance of the antenna 100, 50Ω.

FIG. 24 is a circuit diagram of the other matching circuit of FIG. 17.

The matching circuit 106 as shown in FIG. 24 is substantially equal to the matching circuit as shown in FIG. 17, but one is different from the other in that the capacitor (C1 to C5)

are variable. What the capacitor of the matching circuit 106 is variable means that it is possible to change the phase difference of currents which is provided for the dipole 102 and the loop 104, if necessary. It can allow the radiation pattern to be changed while it maintains the matching mechanism of the dipole 102 and the loop 104.

For example, when a user covers the mobile communication terminal with the antenna 100 with one's hands and makes a phone call, the reception or received power of the antenna 100 is very poor. On the other hand, the antenna 100 with the dipole-loop combination shows the directed radiation as shown in FIG. 21, when the currents with $90°_{\Gamma}$ phase difference are provided for both a single dipole and a single loop of the antenna 100 simultaneously On the other hand, when a user a user makes a phone call without covering the mobile communication terminal with one's hands or inside an area of good reception, the received power is good. In this case, the capacitance for the variable capacitor as shown in FIG. 24 may be changed so as to make the antenna 100 possible to have all-directed radiation pattern without a null point as shown in FIG. 25.

Therefore, the manufacturers for the terminal, for example, the mobile communication terminal with the antenna 100 according to one embodiment may design the matching circuit of FIG. 19 which provides the currents with $90°_{\Gamma}$ phase difference for the dipole 102 and the loop 104, in order to be able to use the antenna 100 within the poor reception area.

FIG. 25 illustrates all-directed radiation pattern without a null point for the antenna.

They may design the matching circuit of FIG. 24 which changes the path difference of the currents for the dipole 102 and the loop 104, in order to be able to adjust to the radiation pattern depending on changing the circumstance on the microwave.

Although embodiment is described above, the present invention is not limited thereto.

According to the above-described embodiments, although the dipole and the loop are formed on both sides of the substrate, they may be formed on the same side. In this case, the dipole may be located inside the loop.

As described above, although the matching circuit is an LC circuit composed of the capacitors and the inductor, but the present invention is not limited thereto. For example, the present invention may comprise only one of the capacitors of the inductors in order to provide the currents with 90° phase difference for the antenna or to change the phase difference of the currents.

As described above, although the variable capacitors for the matching circuit is used to change the phase difference of the currents, but the present invention is not limited thereto. If so, elements or components for the matching circuit is not limited. For example, it is possible to use the variable inductors in order to change the phase difference of the currents.

The embodiments have been described for illustrative purposes, and those skilled in the art will appreciate that various modifications, additions and substitutions are possible without departing from the scope and spirit of the invention as disclosed in the accompanying claims. Therefore, the scope of the present invention should be defined by the appended claims and their legal equivalents.

What is claimed is:

1. An antenna comprising:

a substrate;

a dipole placed on one side of the substrate;

a loop placed on another side of the substrate substantially opposite to the side of the substrate on which the dipole is formed, wherein a radiation center of the loop substantially coincides with a radiation center of the dipole; and a matching circuit on the substrate, wherein the matching circuit comprises at least one of a variable capacitor or a variable inductor, and wherein the matching circuit changes phases of electric currents to provide a directed radiation pattern by the antenna if a received power is poor, and the matching circuit changes the phases of electric currents to provide an all-directed radiation pattern by the antenna if the received power is good.

2. The antenna of claim 1, wherein the dipole is formed as a strip structure.

3. The antenna of claim 1, wherein a phase difference of electric currents supplied for the dipole and the loop is 90°.

4. The antenna of claim 1, wherein a phase difference of electric currents supplied for two ports of the loop is 180°.

5. The antenna of claim 1, wherein the matching circuit is configured to provide substantially equal power radiated by both the dipole and the loop.

6. The antenna of claim 5, wherein the matching circuit changes a phase difference of electric currents supplied for the dipole and the loop.

7. The antenna of claim 5, wherein the matching circuit is an LC circuit.

8. The antenna of claim 5, wherein the dipole, the loop and the matching circuit are designed as a microstrip integrated circuit.

9. The antenna of claim 1, further comprising a PCB ground.

10. The antenna of claim 1, wherein the loop comprises a lumped capacitor at a middle position of the loop.

11. The antenna of claim 10, further comprising:

a plurality of connecting ports connecting the dipole and the loop with the matching circuit, wherein the loop is rectangular and the lumped capacitor is located opposite the connecting ports.

12. A mobile terminal comprising an antenna, the antenna comprising:

a substrate;

a dipole placed on the substrate;

a loop placed on the substrate, wherein a radiation center of the loop substantially coincides with a radiation center of the dipole; and a matching circuit on the substrate, wherein the matching circuit comprises at least a variable capacitor or a variable inductor, wherein the matching circuit changes phases of electric currents to provide a directed radiation pattern by the antenna if a received power is poor, and the matching circuit changes the phases of electric currents to provide an all-directed radiation pattern by the antenna if the received power is good.

13. The mobile terminal of claim 12, wherein the matching circuit is configured to provide substantially equal power radiated by both the dipole and the loop.

14. The mobile terminal of claim 13, wherein the matching circuit changes a phase difference of electric currents supplied for the dipole and the loop.

15. The mobile terminal of claim 13, wherein the matching circuit is an LC circuit.

16. The mobile terminal of claim 12, wherein the antenna further comprises a PCB ground.

* * * * *